US008347680B2

(12) United States Patent
Widén

(10) Patent No.: US 8,347,680 B2
(45) Date of Patent: Jan. 8, 2013

(54) LOCK AND KEY COMBINATION WITH A LARGE NUMBER OF CODES

(75) Inventor: Bo Widén, Torshälla (SE)

(73) Assignee: Winloc AG, Zug (CH)

( * ) Notice: Subject to any disclaimer, the term of this patent is extended or adjusted under 35 U.S.C. 154(b) by 0 days.

(21) Appl. No.: 13/121,521

(22) PCT Filed: Sep. 30, 2009

(86) PCT No.: PCT/SE2009/000430

§ 371 (c)(1),
(2), (4) Date: May 10, 2011

(87) PCT Pub. No.: WO2010/039078

PCT Pub. Date: Apr. 8, 2010

(65) Prior Publication Data

US 2011/0219833 A1 Sep. 15, 2011

(30) Foreign Application Priority Data

Sep. 30, 2008 (SE) ..... 0802056

(51) Int. Cl.
*E05B 15/08* (2006.01)

(52) U.S. Cl. ..... 70/493; 70/378; 70/392; 70/406; 70/409

(58) Field of Classification Search ..... 70/337, 70/357, 378, 384, 389, 392, 393, 394, 405, 70/406, 409, 493
See application file for complete search history.

(56) References Cited

U.S. PATENT DOCUMENTS

| | | | | |
|---|---|---|---|---|
| 4,235,086 | A * | 11/1980 | Genakis | 70/494 |
| 5,000,019 | A | 3/1991 | Foster | |
| 5,101,648 | A * | 4/1992 | Kuster | 70/358 |
| 5,570,601 | A | 11/1996 | Field | |
| 5,809,816 | A | 9/1998 | Widen | |
| 7,159,424 | B2 * | 1/2007 | Widen | 70/409 |
| 7,487,653 | B2 * | 2/2009 | Widen | 70/409 |
| 2004/0237614 | A1 * | 12/2004 | Ketzler et al. | 70/493 |
| 2005/0061043 | A1 | 3/2005 | Widen | |

FOREIGN PATENT DOCUMENTS

| | | |
|---|---|---|
| EP | 1 503 010 A1 | 2/2005 |
| WO | 98/19032 A1 | 5/1998 |

* cited by examiner

*Primary Examiner* — Christopher Boswell
(74) *Attorney, Agent, or Firm* — Birch, Stewart, Kolasch & Birch, LLP

(57) ABSTRACT

A lock and key combination is disclosed, offering a large number of codes. The combination includes a lock (200) of the kind comprising a housing having a cylindrical bore, a cylindrical key plug (202) and a number of locking pins (205*a*-205*g*) in a row along a key plug axis for locking the key plug against rotation in the cylindrical bore, and a key (100) of the kind comprising a longitudinally extending, substantially flat key blade (102), with at least two longitudinally extending formations. The key blade comprises an upper edge portion having a first code pattern (103) and a lower, massive portion having a second code pattern (104). At least one of the locking pins in said row is a short pin (205*a*, 205*b*, 205*c*) comprising a first, relatively short key sensing part (207, 208) cooperating with the first code pattern (103), and at least another one of the locking pins in said row is a long pin (205*f*, 205*g*, 205*h*) comprising a second, relatively long key sensing part (210, 207, 208) cooperating with the second code pattern (104).

35 Claims, 9 Drawing Sheets

LOCK AND KEY COMBINATION WITH A LARGE NUMBER OF CODES

FIELD OF THE INVENTION

The invention concerns a lock and key combination, offering a large number of codes, the combination including a lock of the kind comprising a housing having a cylindrical bore, a cylindrical key plug being rotatably journalled in said cylindrical bore, said key plug having a longitudinal key slot and a number of locking pins in a row along a key plug axis for locking the key plug against rotation in the cylindrical bore, each locking pin in said row comprising a body part being guided for elevational movement in a cylindrical chamber, and a key sensing part projecting downwards from said body part for contacting one or more code patterns on a key, and a key of the kind comprising a longitudinally extending, substantially flat key blade, which is insertable into said key slot in the key plug of said lock, wherein at least two longitudinally extending formations on said key blade form said code patterns.

Such lock and key combinations are well-known, e.g. from the international patent application published under number WO 2005/028789 A1 (Winloc et al). In the previously known lock and key combination, the locking pins cooperating with a code pattern on the lower portion of the key blade, are constituted by side locking tumblers being accommodated in associated chambers displaced sideways in relation to a row of locking pins cooperating with a code pattern at an upper edge portion of the key blade.

BACKGROUND OF THE INVENTION

Accordingly, in the prior art lock and key system referred to above, there are in fact two adjacent rows of locking tumblers, each cooperating with an associated code pattern on the key blade. Of course, the structure and production of such locks and keys are rather complex and expensive.

OBJECT OF THE INVENTION

Against this background, a main object of the present invention is to provide a lock and key combination which is relatively simple to manufacture and, nevertheless, offers a very large number of code combinations by using virtually the full vertical extension of the key blade for the code patterns, including an upper edge portion and a lower, massive portion thereof. Still, the aim is to utilize a housing and a key plug having a single, preferably linear row of holes or chambers accommodating the tumbler pins.

SUMMARY OF THE INVENTION

According to the invention, this object is met for a lock and key combination where the key blade comprises an upper portion, preferably at an upper half of the key blade, e.g. an edge portion, having a first code pattern and a lower, preferably massive portion at a lower half of the key blade, having a second code pattern, at least one of said locking pins in said row being a short pin comprising a first, relatively short key sensing part cooperating with the first code pattern, and at least another one of said locking pins in said row being a long pin comprising a second, relatively long key sensing part cooperating with the second code pattern.

In this way, it will be possible to utilize virtually the whole vertical extension of the key blade for various code formations, virtually all the way from the lower bottom edge of the key blade up to the upper longitudinal edge. The short pin or pins will cooperate with the first code pattern at the upper part of the key blade, whereas the long pin or pins will engage with the code pattern at the lower, massive portion of the key blade.

According to one aspect of the invention, the code formations in the first code pattern, at the upper edge portion of the key blade, are cut through the whole thickness of the key blade. According to a further aspect of the invention, the code formations of the second code pattern, at the lower, massive portion of the key blade, reach only partially through the thickness of the key blade.

In any case, it will be understood that the number of vertical code levels will be the sum of the code levels of the first code pattern and the code levels of the second code pattern, so in case there are two to ten levels in each of the two code patterns, there will be four to twenty code levels in the combined code pattern arrangement. Of course, this will open up for a very large number of code combinations even for a single row of tumbler pins in a cylinder lock.

A number of essential features of the invention are stated in the claims.

These essential features as well as still further features according to other aspects of the invention, are mentioned below in a detailed description of the invention, reference being made to the drawings.

BRIEF DESCRIPTION OF THE DRAWINGS

FIG. 13*k* shows, in a view from the left in FIG. 13, all the short and long pins in FIG. 13*a* through *j;*

DETAILED DESCRIPTION OF SOME PREFERRED EMBODIMENTS

Figure 1:
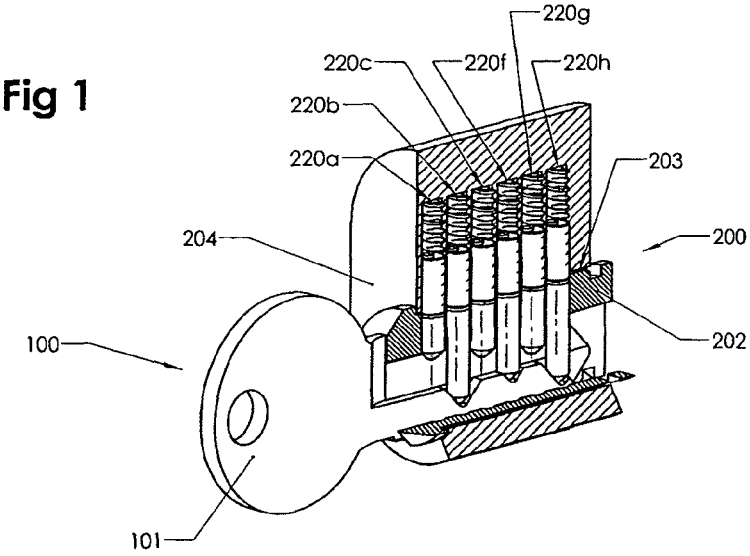
FIG. 1 shows schematically, in a perspective view, a cylinder lock with a key plug and a number of locking pins, and an associated key, the lock being cut through to show the inside thereof.
Figure 2:
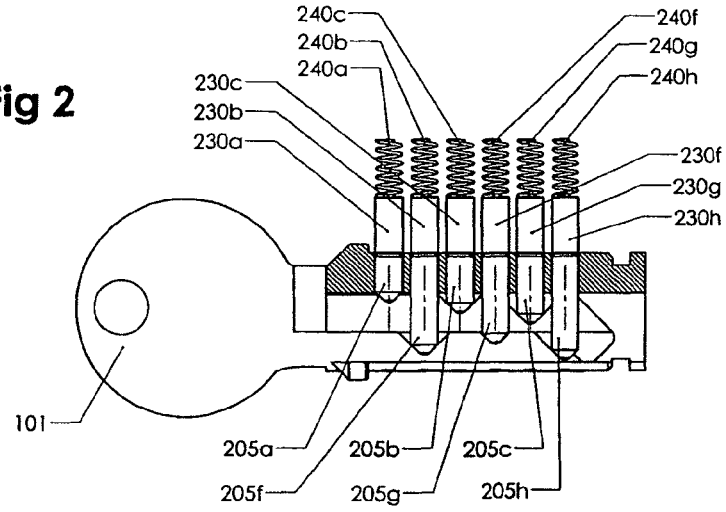
FIG. 2 shows s side view of the lock and key combination, the housing of the lock being left out for clarity.
Figure 3:
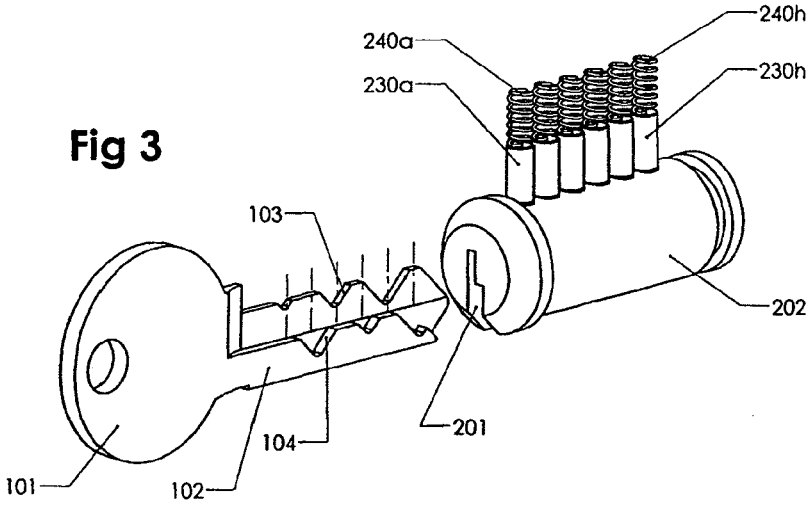
FIG. 3 shows, in a perspective view, the key blade located outside the key plug, shown also in FIGS. 1 and 2.
Figure 4:
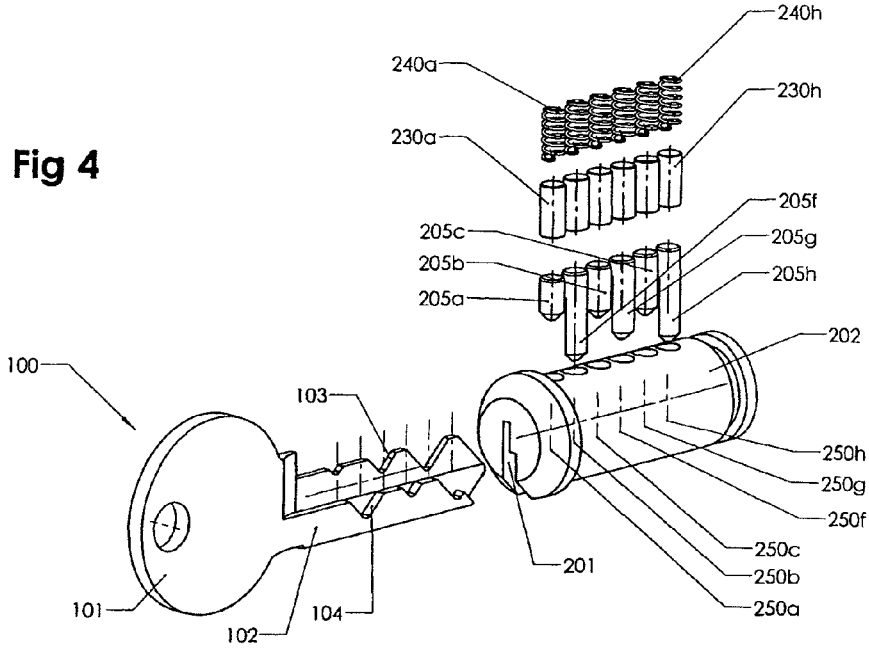
FIG. 4 shows, in a perspective view, the same key and key plug as in FIG. 3, with the row of locking pins being separated from the key plug for clarity.
Figure 5:
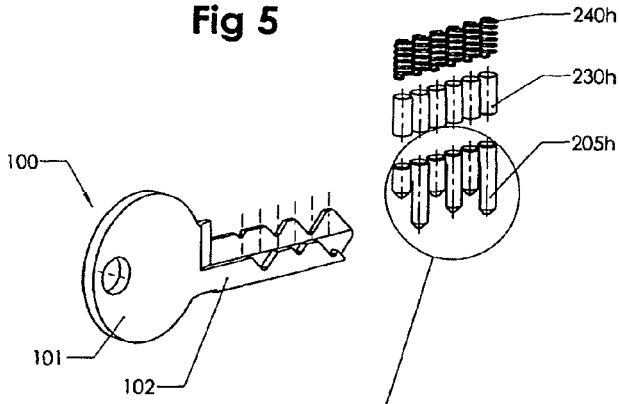
FIG. 5 shows, in a perspective view, the same key blade and locking pins as in FIG. 4, without the key plug.
Figure 6:
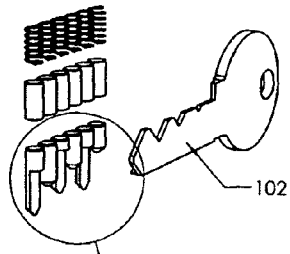
FIG. 6 shows, in a perspective view, the same key blade and locking pins as in FIG. 5, seen from the opposite side.
Figure 5A:
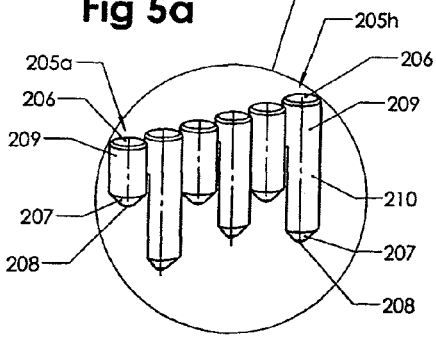
FIG. 5*a* shows, in a larger scale, the locking pins which are accommodated in the key plug (the key plug is not shown in this figure)
Figure 6A:
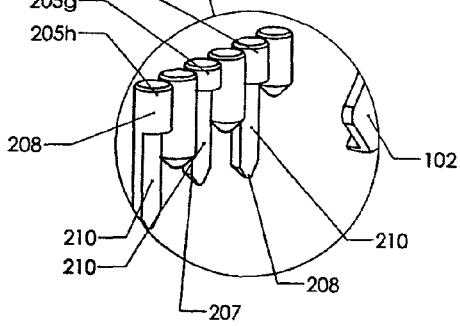
FIG. 6*a* shows the locking pins accommodated in the key plug, in a larger scale (the key plug is not shown in this figure)
Figure 7:
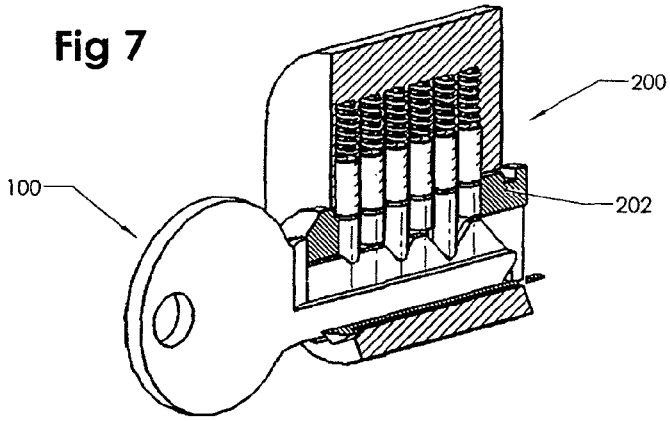
FIG. 7 shows, in a perspective view, a lock and key combination according to a second embodiment of the invention.
Figure 8:
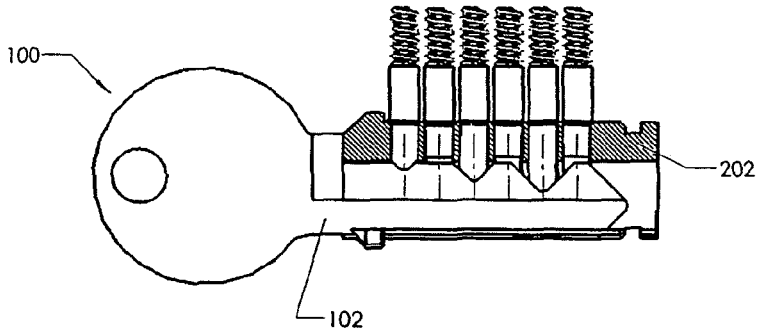
FIG. 8 shows a side view of the second embodiment.
Figure 9:
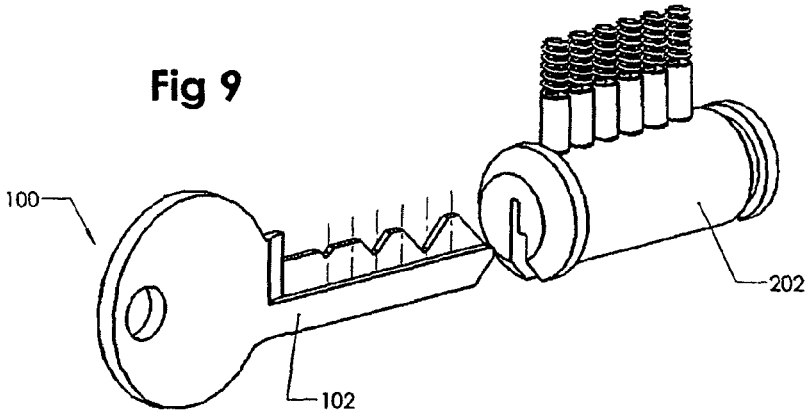
FIG. 9 shows, in a perspective view, the key blade, the key plug and the locking pins of the second embodiment, the housing of the lock being left out for clarity.
Figure 10:
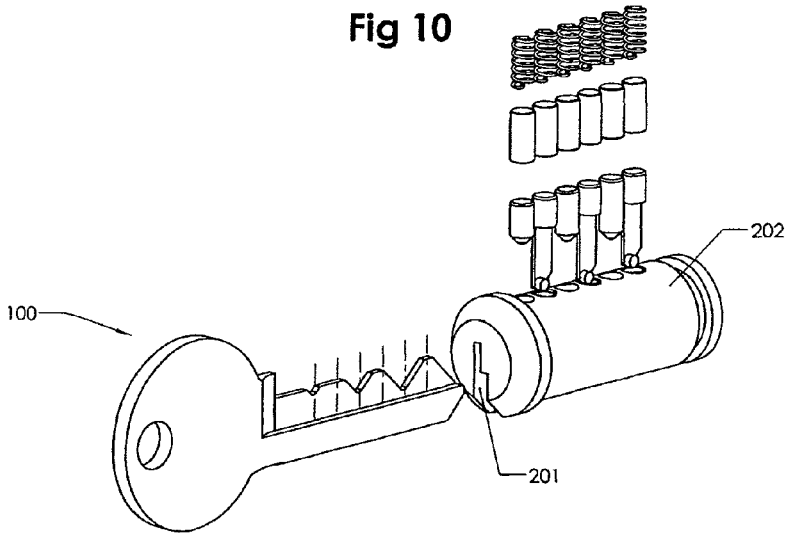
FIG. 10 shows the same key blade and key plug and locking pins as in FIG. 9, the locking pins being shown separately for clarity.

In the drawings, FIGS. 1-3 show a cylinder lock 200 and a key 100 in a combination according to the present invention. The key 100 has a grip portion 101 and a key blade 102, which comprises at least two longitudinally extending formations on said key blade, forming said code patterns. The key is insertable into a key slot 201 of the lock 200. The key slot 201 extends longitudinally in a key plug 202, which is journalled for rotation in a cylindrical bore 203 in a housing 204.

The key blade 102 (see FIG. 3) has a first code pattern with top code formations 103 cut out at the upper edge portion of the key blade, through the whole thickness thereof, e.g. of a conventional type cooperating with relatively short locking pins 205*a*, 205*b* and 205*c* (see also FIGS. 2, 4, 5, 5*a*, 6, 6*a* and 13*a* through 13*c*). The key blade 102 also has a second code pattern 104 with code formations cut only partially through the thickness of the key blade, at the lower massive portion thereof, and cooperating with longer pins in the same row, viz. pins 205*f*, 205*g* and 205*h* (see also FIGS. 4, 5, 5*a*, 6, 6*a* and 13*f* through 13*h*).

All these pins 205*a*, 205*b*, 205*c*, 205*f*, 205*g*, 205*h* are arranged in a linear row in equidistant cylindrical holes or chambers in the key plug 202. These holes or chambers are constituted by bores 250*a*, 250*b*, 250*c*, 250*f*, 250*g*, 250*h* in the key plug 202 and are aligned with corresponding holes 220*a*, 220*b*, 220*c*, 220*f*, 220*g*, 220*h* in the housing 204. The latter holes accommodate upper pins 230*a*, 230*b*, 230*c*, 230*f*, 230*g*, 230*h* and compression springs 240*a*, 240*b*, 240*c*, 240*f*, 240*g*, 240*h*, as is well-known in the art. In the position shown in FIGS. 1 and 2, where the various locking pins engage with the first and second code patterns 103, 104 of the key blade, the upper substantially flat end portions 206 (see also FIG. 5*a*) of the locking pins 205*a*, 205*b*, 205*c*, 205*f*, 205*g*, 205*h* are flush with the outer surface of the key plug, so that the key plug can be rotated in the cylindrical bore of the housing 204.

It should be observed that the reference numerals of the pins 205*a* through 205*h* do not correspond exactly to the upper pins 230*a* through 230*h* in respect of the letters a through h. Rather, the pins are associated to each other as follows: 205*a*-230*a*, 205*b*-230*c*, 205*c*-230*g*, 205*f*-230*b*, 205*g*-230*f*, and 205*h*-230*h*, as can be seen clearly in FIG. 2.

An advantage with the present invention is that it is possible to use a regular, linear row of cylindrical bores 250*a*, 250*b*, 250*c*, 250*f*, 250*g*, 250*h* in the key plug 202 (see FIG. 4) and holes aligned thereto 220*a*, 220*b*, 220*c*, 220*f*, 220*g*, 220*h* in the housing 204 for the various long and short locking pins 205*a*, 205*b*, 205*c*, 205*f*, 205*g*, 205*h* and yet have the locking pins cooperating with code patterns extending over the entire vertical extension of the key blade. This is made possible by the fact that the short pins 205*a*, 205*b*, 205*c* cooperate with the first code pattern 103 at the upper edge portion, at the upper half of the key blade, and the longer pins 205*f*, 205*g*, 205*h* cooperate with the second code pattern 104 at the lower, massive portion at the lower half of the key blade 102.

As will be seen from FIGS. 5*a*, 6*a* and FIGS. 13*a*, 13*b*, 13*c*, 13*f*, 13*g*, 13*h*, the short pins 205*a*, 205*b*, 205*c* have a cylindrical body portion 209 extending substantially along the whole length (or height) of the pin from the substantially flat upper end portion 206 to the lower, tapered end portion 207, which serves as a key sensing portion. In this embodiment, the key sensing end portions 207 of the short pins 205*a*, 205*b*, 205*c* are substantially frustro-conical with a flat or rounded tip 208, which is smooth and has a shape substantially as a segment of a sphere in this case.

The longer locking pins 205*f*, 205*g*, 205*h*, on the other hand (see FIG. 6*a*), have a cylindrical upper body portion 209 and a downwardly extended portion 210. At the lower end thereof, the extended portion 210 has a tapering key sensing portion 207, the lowermost portion 208 of which is rounded so as to provide a smooth contact with the second code pattern 104 of the key blade. From FIGS. 6*a* and FIGS. 13*f*, 13*g*, 13*h*, 13*i*, 13*j* it can be clearly seen that the extended portion 210 and the key sensing portion 207 of the longer pins are longitudinally cut in half in this embodiment, as compared to a full cylindrical shape. In this way the upper edge portion of the key blade can be easily accommodated in the recess formed by the cut away portion of the longer pins. The lowermost smooth end portion 208 of the longer pins will make contact with the second code pattern 104 of the key blade when the key blade is inserted into the key slot of the lock.

Normally, with six pins in the row, there will be three short pins 205*a*, 205*b*, 205*c* alternating with three long pins 205*f*, 205*g* and 205*h*. In the shown embodiment, these pins have different lengths. Accordingly, the first code pattern includes three different vertical code levels, whereas the second code pattern includes three further vertical code levels, all in all six vertical code levels for the pins in the row. Of course, it is possible to have e.g. four of five code levels in each code pattern and a corresponding number of short and long pins having different lengths, as illustrated in FIGS. 13 through 17.

Figure 14:
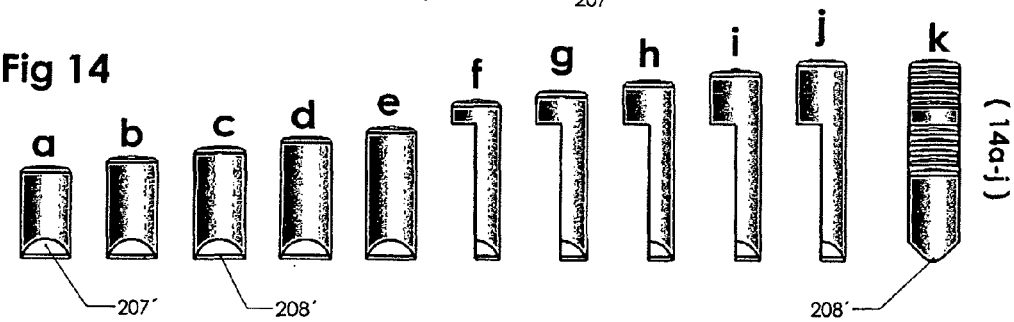
FIGS. 14, 15 and 16 show similar views of three modified embodiments of the short and long pins of FIG. 13.
Figure 15:
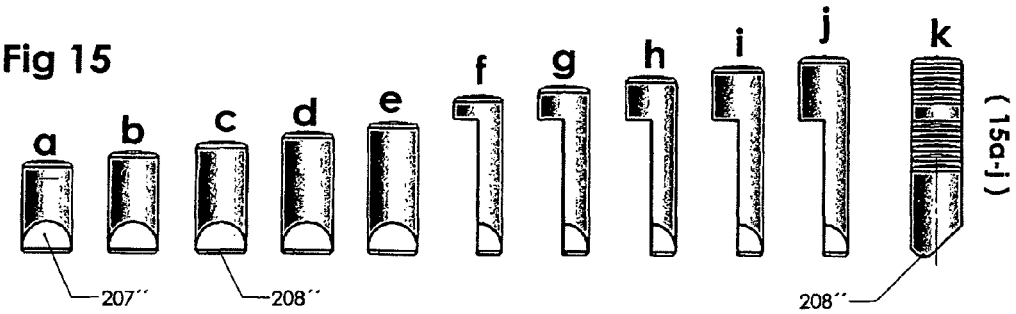

The key sensing portions of each pin may vary in shape. In FIG. 14, the key sensing portion 207' of each pin is chisel-shaped with a symmetrically located lowermost portion 208' (compare FIG. 14 *k*.). In FIG. 15, the key sensing portion 207" is also chisel-shaped, but the lowermost portion 208" is asymmetrically located as illustrated in FIG. 15*k*.

Figure 16:
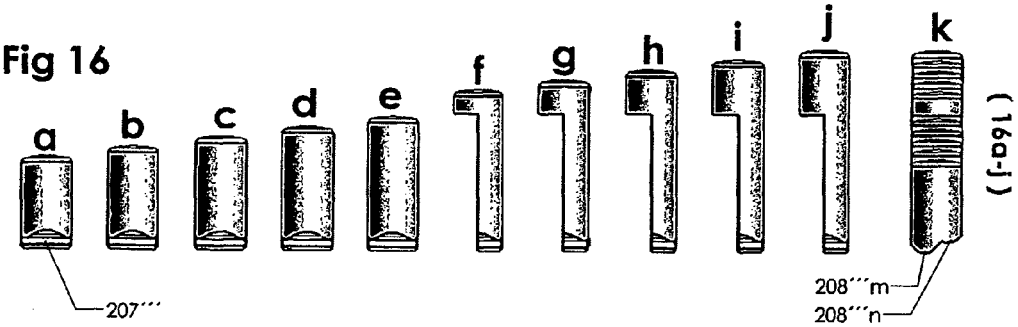

In FIG. 16, there are shown various pins having a lower end portion 207''' with two different key sensing parts 208'''*m*, 208'''*n* of the kind described in the international patent application published under number WO2007/018456.

Figure 17:
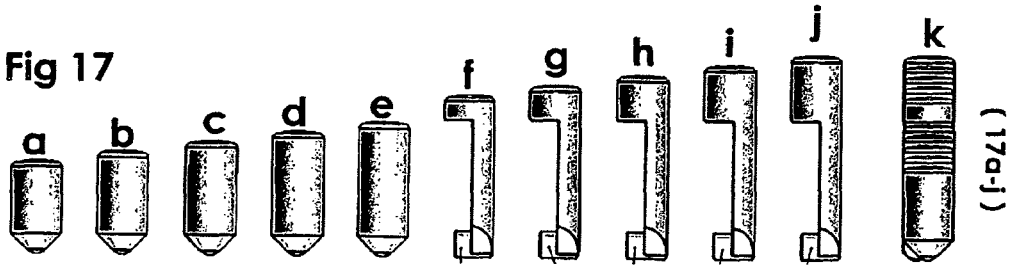
FIG. 17 shows, in a similar view, various short and long pins according to the second embodiment shown in FIGS. 7 through 12.

It is not necessary that the longer pins have end portions being shaped exactly like those of the short pins. An example is shown in FIG. 17, where the short pins are exactly like the ones shown in FIGS. 13*a*, 13*b*, 13*c*, 13*d* and 13*e*. On the other hand, the long pins are provided with transversal projections 211 cooperating with a code pattern formed on the lower wall of a longitudinal groove 105' on one side of the key blade. These projections 211 are shown to be cylindrical. However, they may, alternatively, have a key contacting surface similar those illustrated in FIGS. 13*k*, 14*k*, 15*k*, and 16*k*, extending along the projection.

In case the projections has a key contacting surface as illustrated in FIG. 16*k*, the code pattern on the key blade may be configured as disclosed in the international patent application published under No. WO2007/018456.

Figure 11:
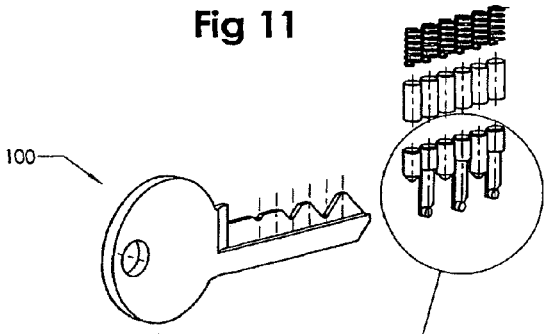
FIG. 11 shows, in a perspective view, the same key and locking pins as in FIG. 10, the key plug being left out for clarity.
Figure 11A:
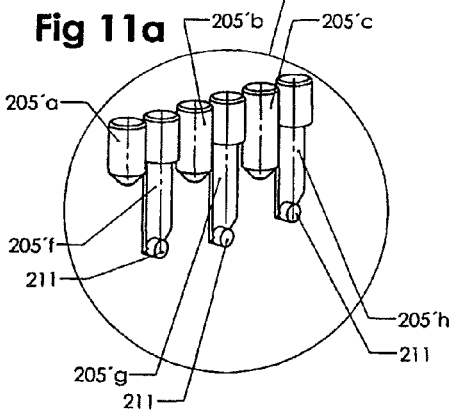
FIG. 11*a* shows, in a larger scale, the locking pins accommodated in the key plug (the key plug itself being left out)
Figure 12:
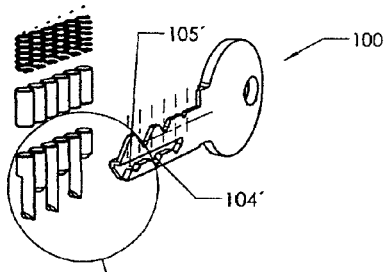
FIG. 12 shows, in a perspective view, the key blade and the locking pins of FIG. 11, from the opposite side.
Figure 12A:
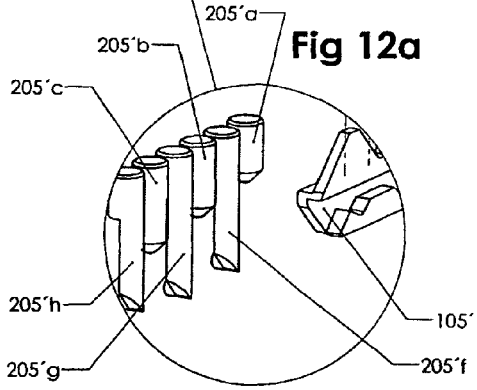
FIG. 12*a* shows, in a larger scale, the locking pins in the key plug and the end portion of the key blade (the key plug being left out)
Figure 13:
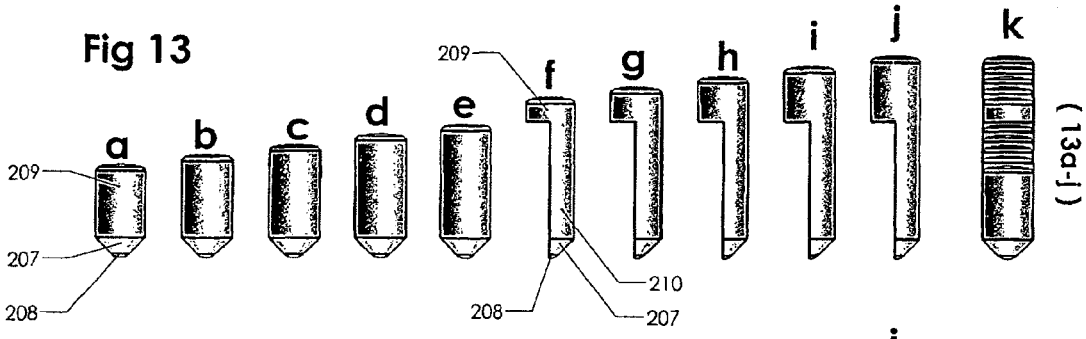
FIG. 13 illustrates, as an example, a number of short pins (a through e) and long pins (f through j) according to the first embodiment shown in FIGS. 1 through 6.

The embodiment with a transverse projection is shown in more detail in FIGS. 7 through 12*a*. FIGS. 7, 8, 9 and 10 correspond to FIGS. 1, 2, 3 and 4, respectively, the only difference being the configuration of the second code pattern 104' (on the back of the key in FIGS. 7-10) and the end portion of the longer pins 205'*f*, 205'*g* and 205'*h* which are all provided with transverse projections 211 cooperating with the modified second code pattern 104' illustrated in FIGS. 12 and 12*a*. The short and long pins (205'*a*, 205'*b*, 205'*c* and 205'*f*, 205'*g*, 205'*h*) in this second embodiment are shown clearly in FIG. 11*a*. It will be understood that the trans-verse projections 211 will project into the groove 105' of the key blade on the side thereof. See FIGS. 12 and 12*a*. So, the projection 211 and the associated long pin 205'*f*, 205'*g*, 205'*h* will therefore move upwards and downwards when the key 100 is inserted into the key slot 201 in response to the second code pattern 104'. The latter is, in this embodiment, wave-like as described in detail e.g. in the international patent application published under number WO 89/06733.

In the two embodiments shown on the drawings, the long and short pins alternate along the row. However, it is of course possible to place the long and short pins in a different order, with two, three or four short or long pins located next to each other. Examples of various combinations of this kind are shown in FIGS. 18*a* through 18*i*. There should be at least one short pin (FIG. 18*i*) and at least one long pin (FIG. 18*g*) in the row.

As illustrated in FIGS. 19, 20, 21, 22, it is quite possible to design locks and keys as a master-key system. For clarity all short pins and long pins are shown to have the same length, respectively. Of course, in practice, different coded lengths are being used.

Figure 18A:
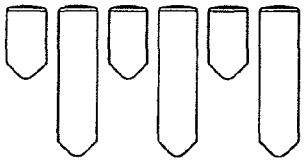
FIG. 18*a* through 18*i* show schematic side views of a number of possible configurations of short and long pins.
Figure 18B:
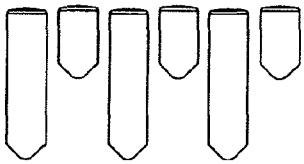
Figure 18C:
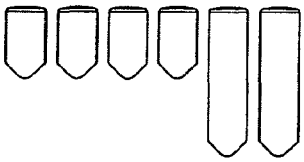
Figure 18D:
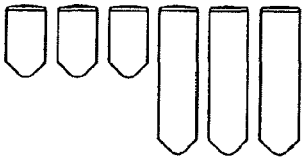
Figure 18E:
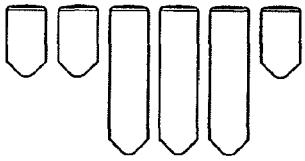
Figure 18F:
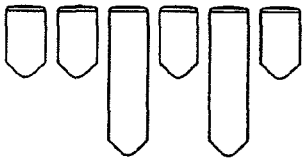
Figure 18G:
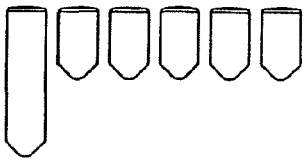
Figure 18H:
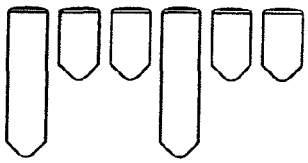
Figure 18I:
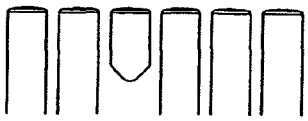
Figure 19:
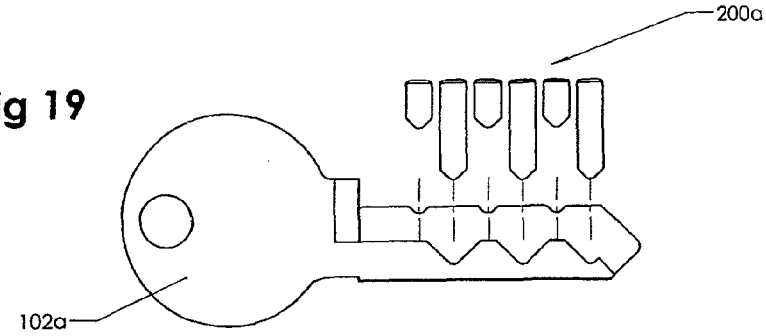
FIGS. 19 through 22 illustrate a lock and key system including keys operating only one specific lock and other keys operating two or more different locks.
Figure 20:
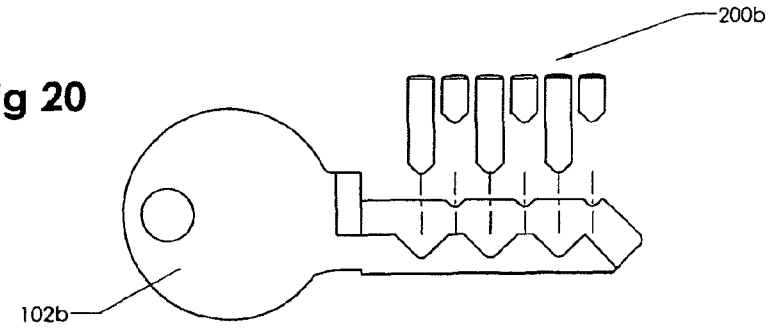
Figure 21:
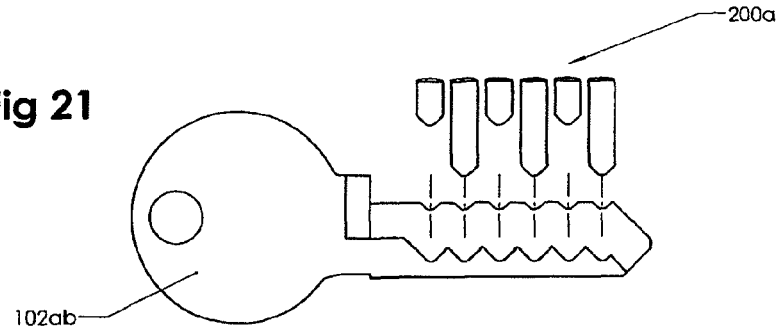
Figure 22:
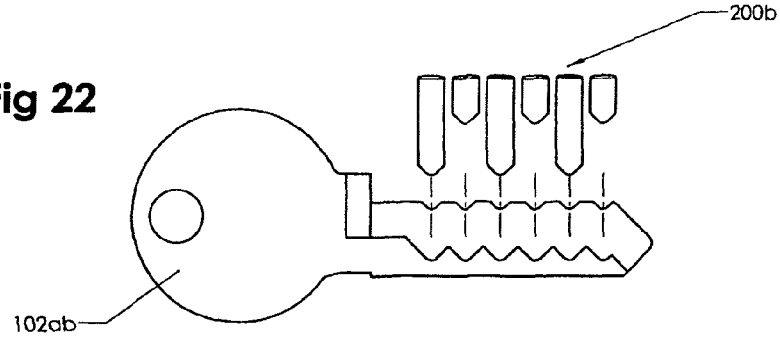

The lock according to FIG. 19 corresponds to the one shown in FIG. 18*a*, whereas the lock according to FIG. 20 corresponds to the one shown in FIG. 18*b*. The key blades 102*a* and 102*b* will open the associated lock 200*a* and 200*b*, respectively, but not the other. However, as will be apparent from FIGS. 21 and 22, a master key blade 102*ab* will open both of the locks 200*a*, 200*b*, since it is provided with a code pattern having code portions corresponding to all of the pins in both locks. In fact, such a master key will also open locks having pin combinations as illustrated in FIGS. 18*c* through 18*i* (provided that all pins have a length corresponding to each code portion of the key blade).

Those skilled in the art can modify the embodiments disclosed above in a number of ways within the scope of the appended claims. The row may be located in the central vertical plane of the key slot or be displaced somewhat sideways relative to such a plane. The number of pins in the row may be different. Also, as illustrated in FIGS. 18*a* through 18*i*, it is possible to have more long pins than short pins, or the other way round.

It would also be possible to have key sensing parts in the form of transverse projections (211) in FIGS. 11*a*, 12*a* and 17*g* through 17*j* on the short pins as well as on the long pins. Then, the code pattern at the upper edge portion of the key does not have to be cut through the whole thickness of the key blade. If necessary, the pins may be provided with guiding means, e.g. in the form of wings, such as those disclosed in the international patent application No. PCT/SE2006/000913 that will ensure that they are rotationally controlled always oriented correctly for proper cooperation with the key blade.

Figure 23:
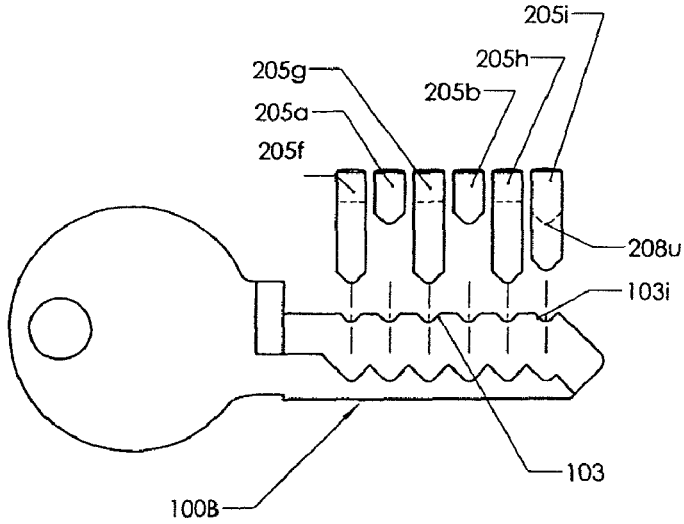
FIGS. 23 and 24 show schematically two different keys cooperating with a lock having a long pin provided with two key sensing parts.
Figure 24:
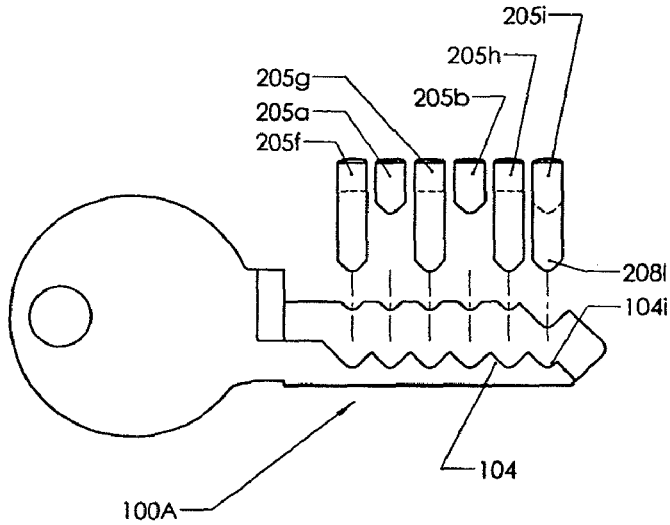
Figure 25:
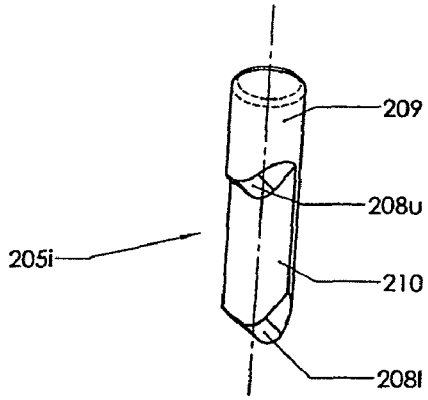
FIG. 25 shows, in a perspective view, the long pin having two key sensing parts.
Figure 26A:
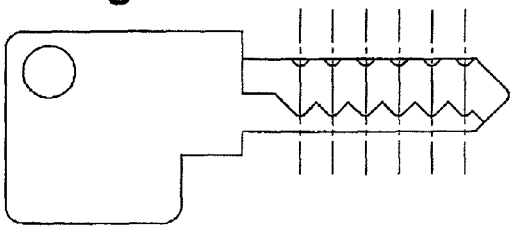
FIGS. 26*a* to 26*f* show additional views of the present invention.
Figure 26B:
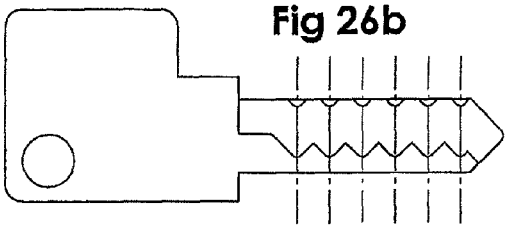
Figure 26B:
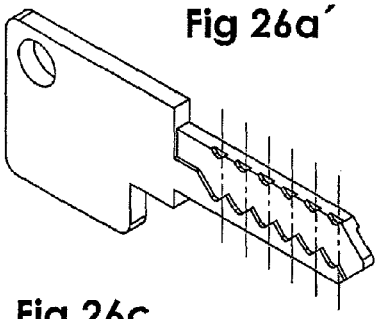
Figure 26C:
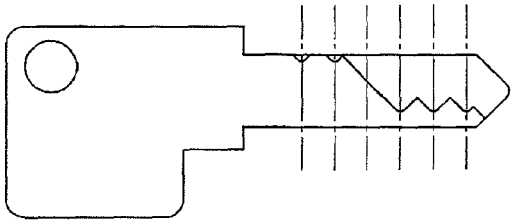
Figure 26D:
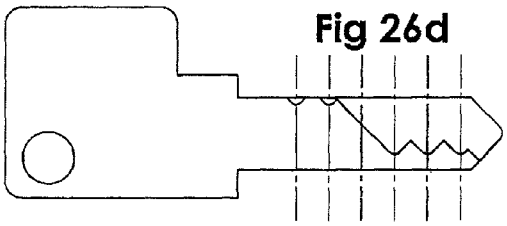
Figure 26D:
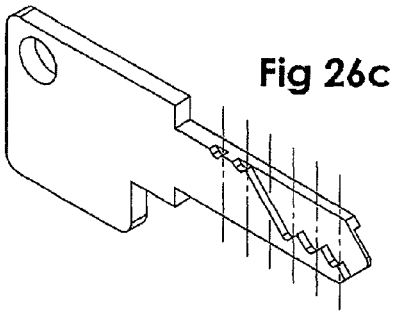
Figure 26D:
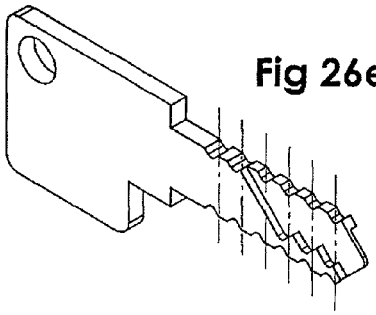
Figure 26E:
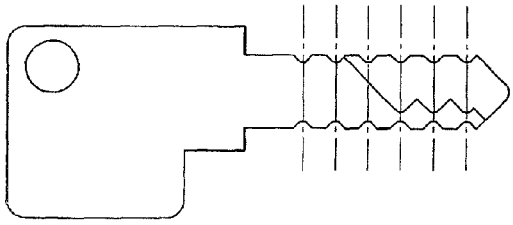
Figure 26F:
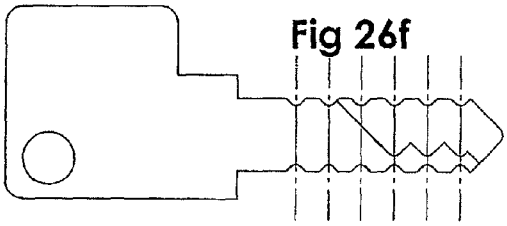

Furthermore, at least one of the long pins may be provided with two key contacting parts, as illustrated in FIGS. 23 through 25. Here, the row of locking pins includes two short pins 205*a*, 205*b* and four long pins 205*f*, 205*g*, 205*h*, 205*i*. The long pin 205*i* located near the tip of the key blade (see FIG. 25) has a first key sensing part 208*l* located at the lowermost end of the pin, at the end of the downwardly projecting, relatively narrow portion 210, and a second key sensing part 208*u* located at an upper part of the pin, at the lower end of the cylindrical portion 209 thereof.

The first key contacting part or surface portion 208*l* cooperates with the second, lower code pattern 104 (at a code portion 104*i*) of a first associated key 100A (FIG. 24), in the same way as in the embodiments described above, whereas the second, upper key contacting part or surface portion 208*u* (FIG. 23) cooperates with the upper code pattern 103 of a second associated key 100B, where the upper code pattern has a relatively shallow cut 103*i* near the upper edge of the key blade. Thus, the first and second key contacting parts 208*l*, 208*u* cooperate with different code patterns 103,104 of different associated keys 100B,100A.

By this feature, the code combinations can be increased even more, and keys with key blades having shallow and deep upper cuts can be used in master key systems. It is also possible to differentiate between the lower and upper key sensing parts by allocating keys having a key blade with a small height (from the lower edge to the upper edge) for contacting the lower key sensing part 208*l* with the second, lower code pattern 104 and keys having a key blade with a greater height (from the lower edge to the upper edge) for contacting the upper key sensing part 208*u* with the first, upper code pattern 103.

However, according to the invention, there should always be at least one short pin cooperating with a first, upper code pattern and at least one long pin cooperating with a second, lower code pattern of an associated key.

It is also conceivable to make two code patterns on each side of the key blade, in such a way that the key is turnable upside down and can still operate a lock. In such a case, the massive part of the blade may be located at half the height of the key blade, with a first code pattern situated on each longitudinal edge of the key blade. Alternatively, the key blade may have a substantially uniform thickness all the way between the longitudinal edges.

The invention claimed is:

1. A lock and key combination including a lock (200) of the kind comprising:

a housing (204) having a cylindrical bore (203), a cylindrical key plug (202) being rotatably journalled in said cylindrical bore, said key plug having a longitudinal key slot (201) and a number of locking pins (205*a*-205*h*) in a single row along a key plug axis for locking the key plug against rotation in the cylindrical bore, each locking pin in said single row comprising a body part (209) being guided for elevational movement in a cylindrical chamber (250*a*-250*h*), and a key sensing part (207, 208; 210, 207, 208) projecting downwards from said body part for contacting one or more code patterns (103, 104) on a key, and a key (100) of the kind comprising:

a longitudinally extending, substantially flat key blade (102), which is insertable into said key slot in the key plug of said lock, at least two longitudinally extending formations on said key blade, forming said code patterns (103, 104), wherein said key blade comprises an upper portion having a first code pattern (103) and a lower portion having a second code pattern (104), at least one of said locking pins in said single row being a short pin (205*a*, 205*b*, 205*c*) comprising a first, relatively short key sensing part (207) cooperating with said first code pattern (103), and at least another one of said locking pins in said single row being a long pin (205*f*, 205*g*, 205*h*) comprising a second, relatively long key sensing part (210, 207, 208) cooperating with said second code pattern (104).

2. The lock and key combination as defined in claim 1, wherein said upper portion is an edge portion and said lower portion is a massive portion of the key blade.

3. The lock and key combination as defined in claim 1, wherein said single row comprises at least five locking pins with at least two short pins and at least two long pins.

4. The lock and key combination as defined in claim 3, wherein said single row comprises alternating short and long pins, so that a first set of short pins is interleaved with a second set of long pins.

5. The lock and key combination as defined in claim 4, wherein each short pin is allocated to a code formation located at one of at least two vertical levels in said first code pattern.

6. The lock and key combination as defined in claim 4, wherein each long pin is allocated to a code formation located at one of at least two second vertical levels in said second code pattern, said second vertical levels being situated below said first vertical levels.

7. The lock and key combination as defined in claim 4, wherein there are at least three vertical levels in said first code pattern and at least three vertical levels in said second code pattern.

8. The lock and key combination as defined in claim 7, wherein said at least one short locking pin has a tapering end portion (207) with at least one smooth key sensing part (208).

9. The lock and key combination as defined in claim 8, wherein said tapering end portion (207) is frustro-conical.

10. The lock and key combination as defined in claim 8, wherein said tapering end portion (207") is asymmetrical with a smooth end portion (208") located at a distance from the central axis of said circular-cylindrical body part of the pin (208).

11. The lock and key combination as defined in claim 8, wherein said at least one short locking pin has a chisel shaped key sensing part (207').

12. The lock and key combination as defined in claim 1, wherein said body part of each pin in said single row is substantially circular-cylindrical.

13. The lock and key combination as defined in claim 12, wherein said at least one short locking pin has an end portion with two key sensing parts (208'"m, 208'"n) being located at a mutual distance from each other.

14. The lock and key combination as defined in claim 13, wherein said two key sensing parts (208'"m, 208'"n) are located at a mutual distance from each other in a longitudinal direction along said single row of pins.

15. The lock and key combination as defined in claim 1, wherein said at least one long pin has a downwardly extending portion (210) which is part-cylindrical and is provided with at least one smooth key sensing part (207, 208), said part-cylindrical portion being dimensioned to move elevationally adjacent to a side surface of said flat key blade (102) when the latter is inserted into said key slot of the key plug.

16. The lock and key combination as defined in claim 15, wherein said long pin has a tapering end portion (207) provided with said key sensing part (20).

17. The lock and key combination as defined in claim 15, wherein the lower end portions of said at least one long pin has two key sensing parts (208'"m, 208'"n) being located at a mutual distance from each other.

18. The lock and key combination as defined in claim 17, wherein said two key sensing parts (208'"m, 208'"n) are located at a mutual distance from each other in a longitudinal direction along said single row of pins.

19. The lock and key combination as defined in claim 15, wherein said part-cylindrical portion (210) of said long pin has a cross-section forming a segment of a circle.

20. The lock and key combination as defined in claim 19, wherein said straight line of said single row of short and long pins is displaced sideways relative to a central vertical plane through said key slot.

21. The lock and key combination as defined in claim 1, wherein said first code pattern (103) comprises code formations being cut through the whole thickness of the key blade.

22. The lock and key combination as defined in claim 1, wherein said second code pattern (104) comprises code formations reaching only partially through the thickness of the key blade (102) at a lower massive portion.

23. The lock and key combination as defined in claim 22, wherein said long pin has an end portion provided with a transversely projecting key sensing part (211), said transversely projecting key sensing part cooperating with said second code pattern (104') being formed on one side of said key blade.

24. The lock and key combination as defined in claim 23, wherein said second code pattern is formed on a shelf surface at one side of the key blade.

25. The lock and key combination as defined in claim 24, wherein said second code pattern is formed on a wall of a groove (105') at one side of said lower, massive portion of said key blade.

26. The lock and key combination as defined in claim 1, wherein the long and short pins have key sensing portions being similar in shape.

27. The lock and key combination as defined in claim 1, wherein the central axes of the long and short pins in said single row are located along a straight line, in parallel to the key slot (201) of said key plug (202).

28. The lock and key combination as defined in claim 27, wherein, said straight line of said single row of short and long pins is located in a central vertical plane through said key slot (201).

29. The lock and key combination as defined in claim 1, wherein each pin in said single row of short and long pins is aligned with an upper pin (230*a* through 230*h*) guided in a cylindrical chamber in said housing of the lock.

30. The lock and key combination as defined in claim 1, including two different locks, namely a first lock (200*a*) and a second lock (200*b*), a first key (102*a*) having code portions adapted to open the first lock (200*a*) only, a second key having code portions adapted to open the second lock (200*b*) only, and a third key (102*ab*) having code portions adapted to open the first lock (200*a*) as well as the second lock (200*b*).

31. The lock and key combination as defined in claim 1, wherein at least one of said long locking pins is provided with two different key sensing parts located at the lowermost end of the pin and at an upper part of the pin, respectively, these two different key sensing parts cooperating with a lower code pattern of a first associated key and with an upper code pattern of a second associated key, respectively.

32. A lock (200) having a single row of short and long locking pins (205*a* through 205*h*) as defined in claim 1.

33. A key blade (102) having a first code pattern (103) and a second code pattern (104) as defined in claim 1.

34. The key blade (102) as defined in claim 33, wherein said first code pattern (103) is located at an upper half of the key blade, and said second code pattern (104) is located at a lower half of the key blade.

35. The key blade as defined in claim 33, wherein the key blade is turnable upside down, and each side of the key blade is provided with said first code pattern as well as said second code pattern.

* * * * *